US007052081B2

(12) United States Patent
Leng

(10) Patent No.: US 7,052,081 B2
(45) Date of Patent: May 30, 2006

(54) FOLDABLE CHAIR

(75) Inventor: Lu Hao Leng, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 9 days.

(21) Appl. No.: 10/396,431

(22) Filed: Mar. 26, 2003

(65) Prior Publication Data

US 2004/0239153 A1 Dec. 2, 2004

(30) Foreign Application Priority Data

Mar. 29, 2002 (CN) ..... 02213632 U
May 31, 2002 (CN) ..... 02214988 U

(51) Int. Cl.
*A47C 4/44* (2006.01)

(52) U.S. Cl. ..... 297/58

(58) Field of Classification Search ..... 297/16.1, 297/16.2, 34, 41, 45, 55, 58; 280/47.4, 650
See application file for complete search history.

(56) References Cited

U.S. PATENT DOCUMENTS 1,789,295 A * 1/1931 Bauer ..... 297/35
2,555,113 A * 5/1951 Burnham ..... 297/55
2,620,019 A 12/1952 Merrill et al.
2,692,011 A * 10/1954 Hickok ..... 297/55
2,697,476 A * 12/1954 Tripodi et al. ..... 297/18
2,843,187 A 7/1958 Manne et al.
3,029,105 A 4/1962 Junkunc
3,319,997 A 5/1967 Clement
3,429,611 A 2/1969 Van Ryn
3,466,064 A 9/1969 Moore et al.
4,126,331 A * 11/1978 Sloan et al. ..... 280/650
5,054,848 A 10/1991 Liu
5,096,259 A 3/1992 Stanfield
5,505,413 A * 4/1996 Hennessey ..... 248/166
5,634,684 A 6/1997 Kojima et al.
5,681,078 A 10/1997 Chen
5,707,105 A 1/1998 Liu
5,718,474 A 2/1998 Kojima et al.
5,782,528 A 7/1998 Cioncada
5,899,525 A 5/1999 Tseng
5,964,500 A 10/1999 Lin
6,062,639 A 5/2000 Hill
6,082,813 A * 7/2000 Chen ..... 297/16.2
6,092,866 A 7/2000 Wu
6,095,596 A 8/2000 Chen
6,095,597 A 8/2000 Huang
6,099,073 A 8/2000 Bruschi
6,131,992 A 10/2000 Chang
6,193,307 B1 2/2001 Lin
6,206,462 B1 3/2001 Huang
6,234,571 B1 5/2001 Atkins et al.
6,386,627 B1 5/2002 Tsai
6,517,151 B1 * 2/2003 Liu ..... 297/16.1
2001/0033100 A1 10/2001 Haney
2002/0140255 A1 10/2002 Liu
2002/0171268 A1 11/2002 Liu
2002/0175540 A1 11/2002 Liu

* cited by examiner

*Primary Examiner*—Peter R. Brown
(74) *Attorney, Agent, or Firm*—Barnes & Thornburg LLP

(57) ABSTRACT

A foldable chair that includes front legs, rear legs, a seat and a collar slidable on the front legs pivotally coupling the front and rear legs.

49 Claims, 3 Drawing Sheets

FOLDABLE CHAIR

Foreign priority is hereby claimed under 35 U.S.C. §119 to Chinese Patent Application No. 02 2 13632.0, filed in the People's Republic of China on Mar. 29, 2002 and Chinese Patent Application No. 02 2 14988.0, filed in the People's Republic of China on May 31, 2002, the disclosures of which are hereby incorporated by reference herein.

BACKGROUND

The present disclosure relates to chairs. More particularly, the present disclosure relates to foldable chairs.

Foldable chairs of the A-frame variety typically have a pair of front and rear legs, or a pair of front and rear frames formed into U-shaped stands, connected with a seat that is normally pivotally and/or rotatably mounted to the front and rear legs or frames. A backrest may be mounted at or near an upper end of the front legs. The chair generally has a structure such that as the front and rear legs or frames are moved toward each other, pivoting, linking, rotating and/or sliding members permit the seat to rotate toward the backrest and the chair folds into a generally flat configuration. Upon unfolding, the pivoting, linking, rotating or sliding members permit the chair to be secured with the front and rear legs spread apart in an unfolded, in-use position.

SUMMARY

According to the present disclosure, a foldable chair includes a pair of front legs and a pair of rear legs. Also included is a backrest extending from a top end portion of each of the front legs and a seat that is pivotally coupled to the front legs. The foldable chair also includes at least one fixed abutment, or other stopping means, and a collar, or other connection means, slidable on the front legs and pivotally coupling the front and rear legs. The collar cooperates with the at least one fixed abutment to stop a spreading-apart of the front and rear legs during an unfolding of the chair to an in-use position.

Other aspects and features of the present disclosure will become apparent from the following detailed description of the preferred embodiments when considered in conjunction with the accompanying drawings.

DETAILED DESCRIPTION

Figure 1:
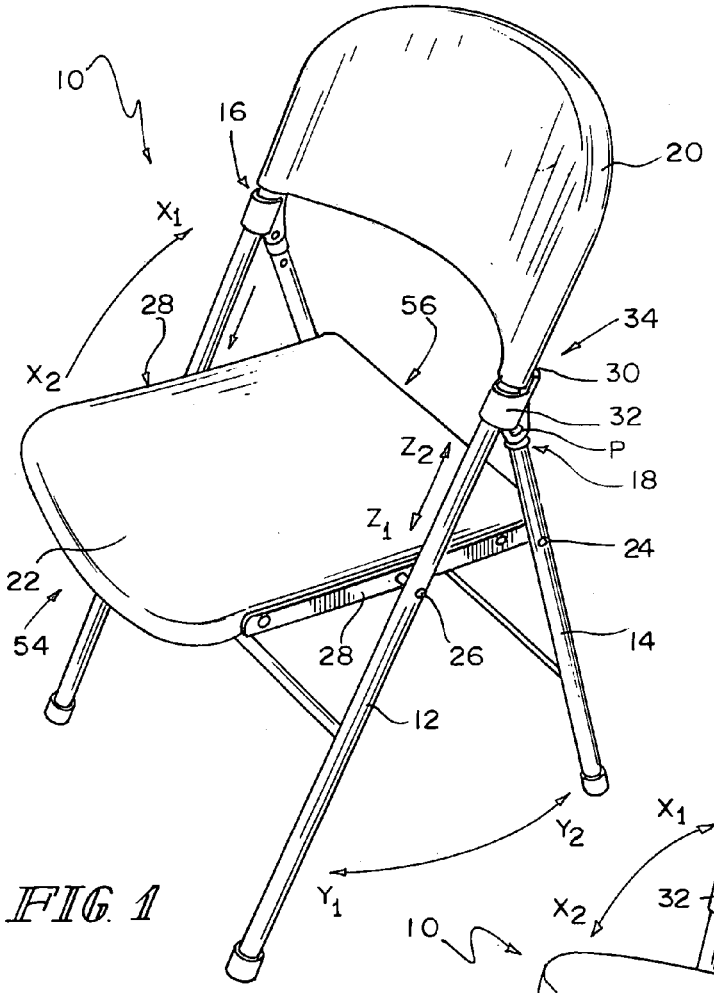
FIG. 1 is a front perspective view of a foldable chair in an unfolded in-use position, according to the present disclosure.
Figure 2:
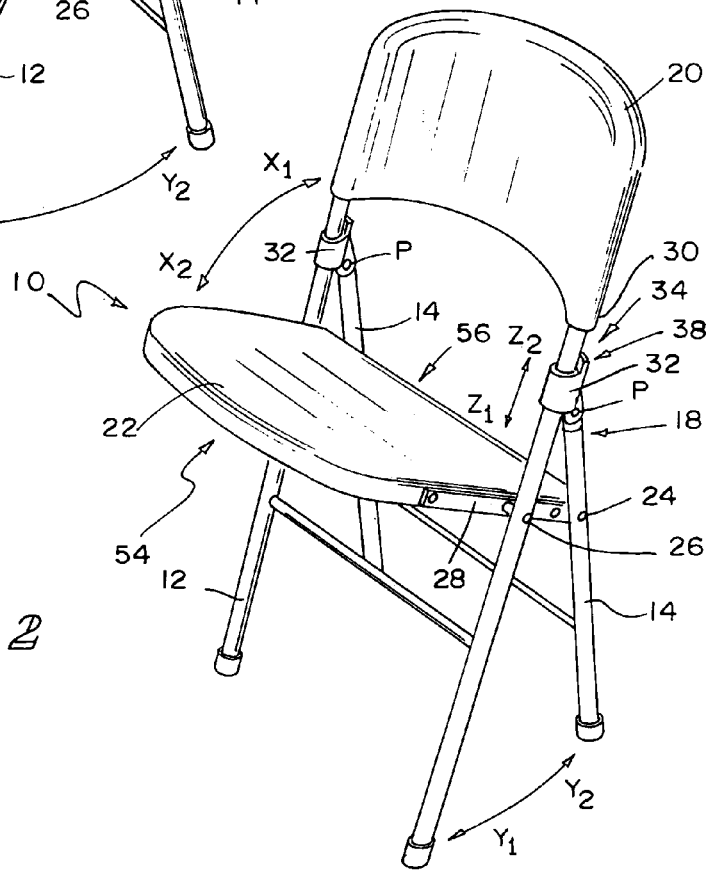
FIG. 2 is a front perspective view of the foldable chair in a position between folded and unfolded positions, according to the present disclosure.
Figure 3:
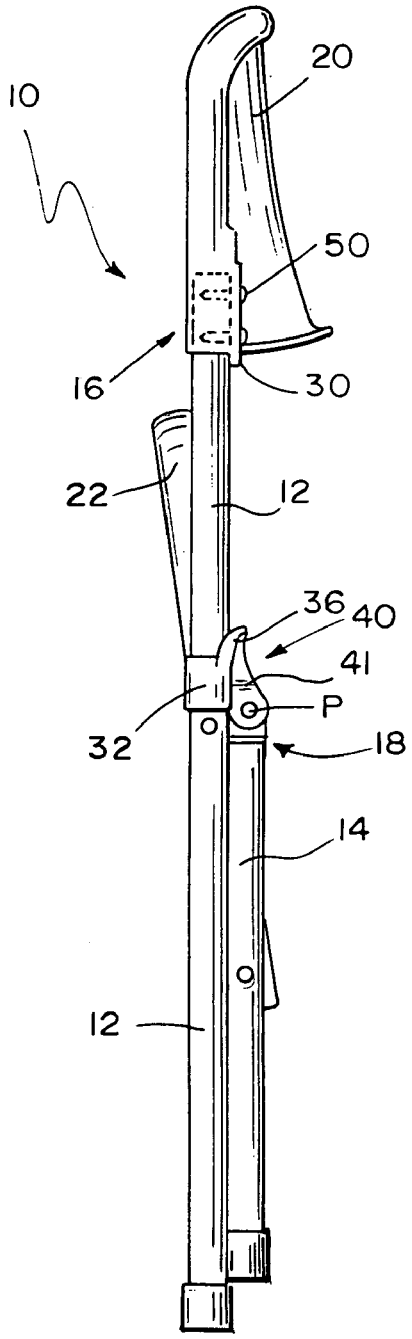
FIG. 3 is a side view of the foldable chair in a folded position, according to the present disclosure.

A preferred embodiment includes a foldable chair 10 shown, for example, in FIGS. 1, 2 and 3. In FIG. 1, chair 10 is in an unfolded or in-use state or condition. In FIG. 3, chair 10 is in a folded or stored state or condition, and in FIG. 2, chair 10 is in a partially-folded condition.

Chair 10 includes a pair of front legs 12 and a pair of rear legs 14. Also included is a backrest 20 that extends from a top end portion 16 of each of the front legs 12. The chair 10 further includes a seat 22 that is pivotally coupled to the front legs 12 at connection 26 and pivotally coupled to rear legs 14 at connection 24. Also included is a connection means, such as, for example, a collar 32 slidable on the front legs 12 and pivotally coupling the front and rear legs 12, 14. The collar 32 cooperates with the fixed abutments 30 to stop a spreading-apart of the front and rear legs 12, 14 during an unfolding of chair 10 to the in-use position, as shown in FIG. 1. Chair 10 also includes a stopping means, such as, for example, at least one fixed abutment 30. While two abutments 30 are shown (one on each lower end 34 of backrest 20), only one abutment 30 is necessary.

Figure 4:
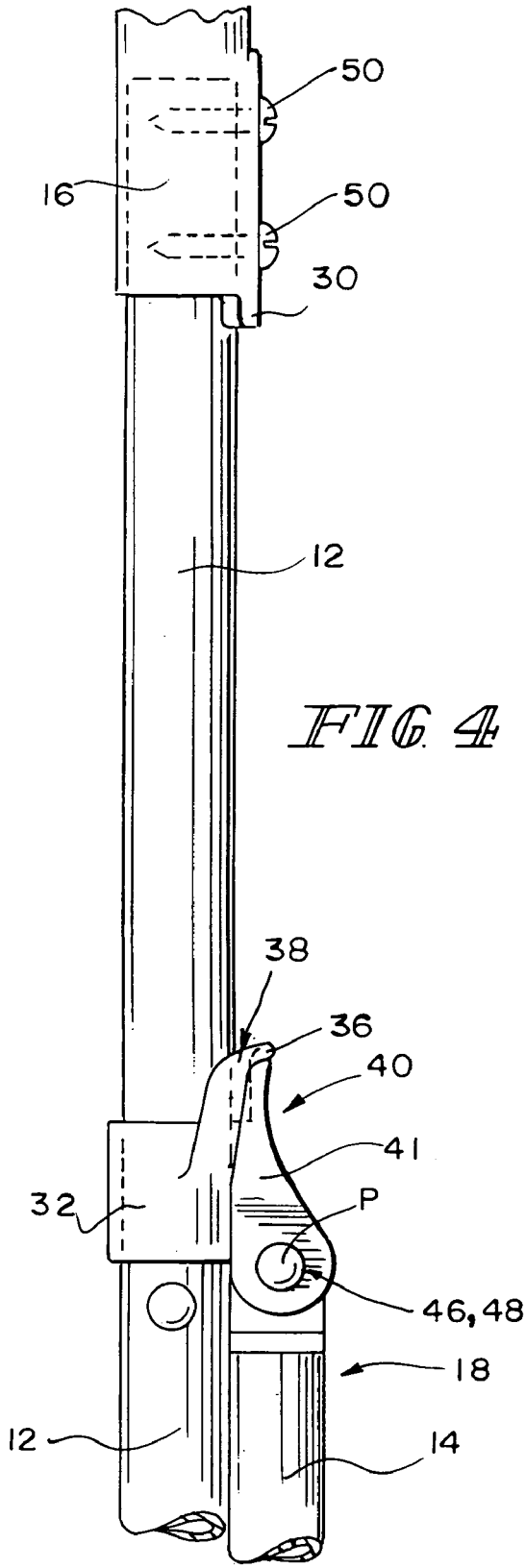
FIG. 4 is a side, enlarged fragmentary view of the connection means of the folded chair of FIG. 3, according to the present disclosure.
Figure 5:
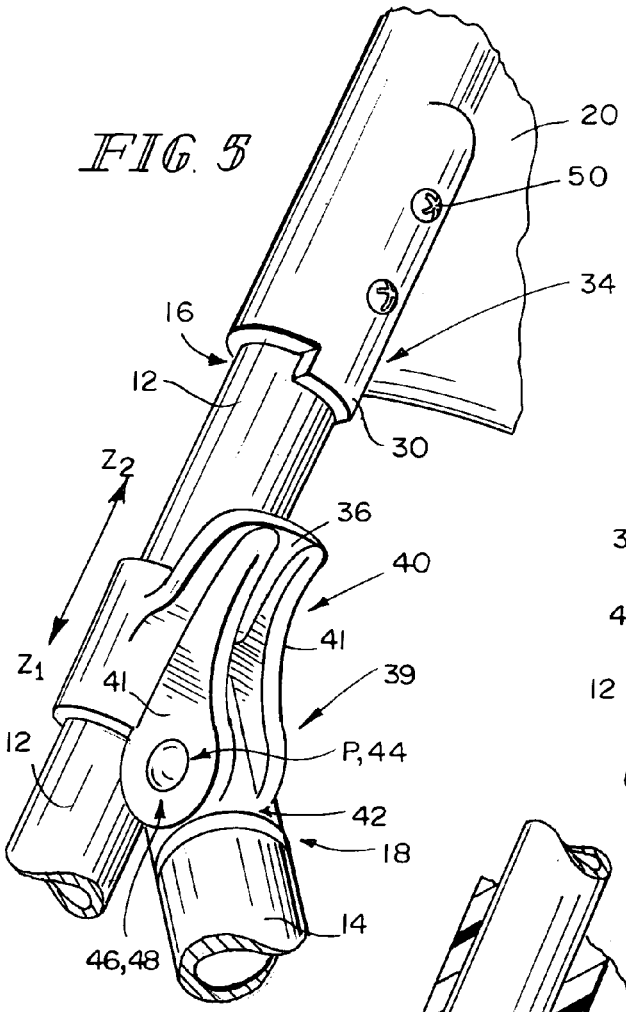
FIG. 5 is a fragmentary perspective view of the connection means in a non-abutted condition, according to the present disclosure.
Figure 6:
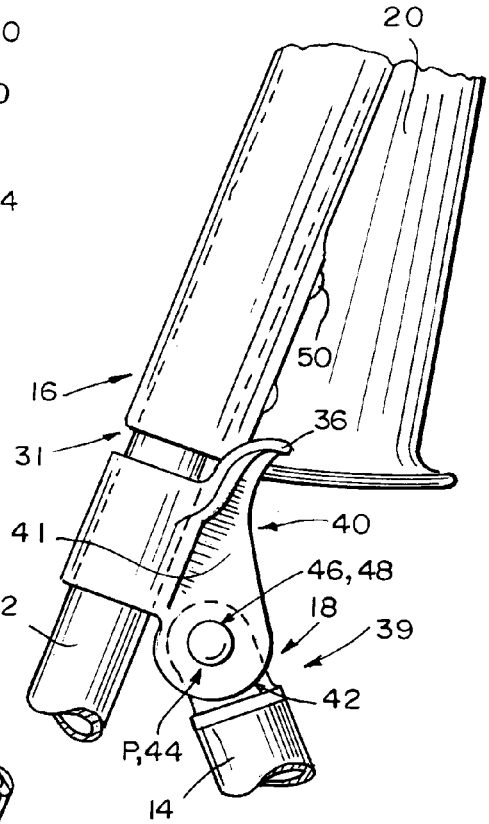
FIG. 6 is a side fragmentary view of the connection means of FIG. 5 in an abutted condition, according to the present disclosure.
Figure 7:
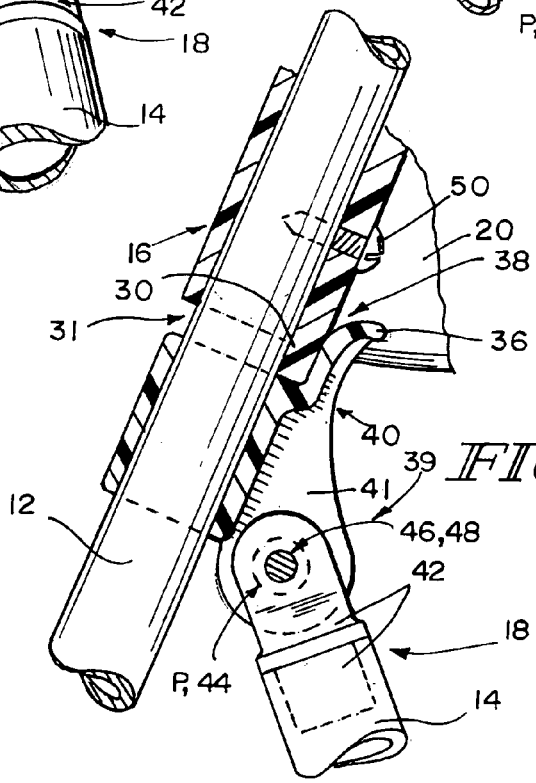
FIG. 7 is a cut-away view of the connection means of FIG. 6, according to the present disclosure.

As shown in FIGS. 1–7, but in more particular detail in FIGS. 5–7, the collar 32 is located on each of the front legs 12. The fixed abutments 30 may be located on lower ends 34 of the backrest 20. The fixed abutments 30 may extend downwardly from each lower end 34 adjacent to, on or along front legs 12. Alternatively, the fixed abutments 30 may be directly mounted on the front legs 12 spaced apart from backrest 20, and may be in the form of pins, screws or tabs that protrude from the front legs 12 to cooperate with the collar 32. Upon a folding of the chair 10, the seat 22 moves in direction $X_1$, the rear legs 14 move in direction $Y_1$ and the collar 32 slides downwardly in direction $Z_1$ (see FIGS. 2, 3 and 5). Upon an unfolding of the chair 10, the seat 22 moves in direction $X_2$, the rear legs move in direction $Y_2$ and the collar 32 slides upwardly in direction $Z_2$ (see FIGS. 1 and 5). The collar 32 may include an element, formed as a lip-shaped extension, 36 or equivalent structure that extends from the collar 32 at an angle such that it creates a slot 38 to receive and/or cooperate with at least a portion of the fixed abutment 30 when the chair 10 is unfolded into an in-use position. The element 36 may be of other sizes and shapes and may be connected to, be made integral or monolithically with the slidable collar 32. Element 36 may act as a guard to protect a user's fingers from getting caught in and/or around slot 38 or caught between collar 32 and fixed abutment 30.

Collar 32 and the fixed abutments 30 create a gap 31 on the front legs (see FIGS. 6 and 7) between the collar 32 and the backrest 20 when the chair 10 is in an unfolded, in-use position. Gap 31 prevents a user's fingers from getting caught between the collar 32 and the backrest when the chair is being unfolded and secured in an in-use position.

The chair 10 may also have a pivot assembly 39 which includes a pivot connector 40, leg insert 42 and pivot pin 44 to pivotally connect the front and rear legs 12, 14, respectively. The pivot assembly 39, as shown in FIGS. 5–7, is connected to collar 32. The pivot connector 40 has two spaced-apart reinforcing elements 41 connected to collar 32 by gluing, or other adhesive bonding, riveting, screwing, or other equivalent securing techniques. Elements 41 reinforce collar 32 to prevent or reduce breaking or a twisting, bending or other undesirable movement of collar 32 in undesirable directions. Pivot connector 40 may also be made integrally or monolithically with collar 32. Pivot connector 40 has a hole 46 in each element 41 to accommodate pivot pin 44, which pin 44 may be secured by rivets, screws, nuts and bolts or other equivalent securing means. Leg insert 42 has a hole 48 that is matched up with holes 46 in elements 41 in order to receive pivot pin 44. Leg insert 42 is inserted into a top portion 18 of rear leg 14 which is configured to receive leg insert 42 and, thus, complete a pivotal connection of the front and rear legs 12, 14.

In an alternative embodiment, the leg insert 42 with hole 48, is included as part of the rear leg 14. Leg insert 42 may be insertable into rear leg 14 or be made integrally or monolithically with rear leg 14. Leg insert 48 is then connectable with pivot connector 40 of the collar 32, using holes 46, 48 and pivot pin 44.

In another embodiment, pivot assembly 39 is a unified element (not shown) that is monolithically formed with collar 32 or connected to collar 32. The pivot connector 40 portion may have two spaced-apart reinforcing elements 41 with holes 46 to receive pivot pin 44. Or, connector 40 may be a single reinforcing element having protrusions and/or receptacles for cooperating with leg insert 42 portion to provide a pivotal coupling for the front and rear legs 12, 14 (this embodiment not shown). Accordingly, the leg insert 42 may be protrusions and/or receptacles for cooperating with connector 40 to provide the pivotal coupling of the front and rear legs 12, 14.

The backrest 20 may be integral to, monolithically produced with or fixedly secured to the front legs 14. As shown in FIGS. 3–7, for example, the backrest is secured by screws 50 to front legs 14.

The pair of front legs 12 and rear legs 14 are spaced apart as shown in FIGS. 1 and 2 and connected to seat 22. The seat 22 may have its lateral sides 28 pivotally coupled at connection 24 to the rear legs 14 near a rear end 52 of seat 22 and pivotally coupled to the front legs 12 at connection 26 forward of coupled connection 24 toward a front end 54 of seat 22.

FIG. 3 shows foldable chair 10 in a folded position having the rear legs 14 in a relatively higher position than the front legs 12. This feature permits the foldable chair 10 to take up relatively less space upon being folded and/or upon stacking (not shown). However, if desired, the rear legs 14 may be of relatively equal length after chair 10 is folded.

FIG. 4 shows the collar 32 in an unabutted condition, with the collar 32 having slid down the front leg 12 to the position as also shown in FIG. 3.

The foldable chair 10 generally is folded and unfolded, for example, as follows, as shown in FIGS. 1–3. Starting in the unfolded position of FIG. 1, the front end 54 of seat 22 is lifted in direction $X_1$ and pivots about front legs 12 at connection 26 and about rear legs 14 at connection 24, thereby causing rear legs 14 to move in direction $Y_1$, (see FIGS. 1 and 2). Simultaneously, collar 32 is moving in direction $Z_1$, downwardly on front legs 12 while rear legs 14 are rotating at point P, permitting rear legs 14 to continue to move in direction $Y_1$. Continued movement of seat 22 in direction X causes rear legs 14 and collar 32 to create a folded chair 10, as shown in FIG. 3. To unfold chair 10, the movements discussed above occur in reverse, with collar 32 eventually abutting fixed abutment 30, as shown in FIGS. 1, 6 and 7.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

What is claimed is:

1. A foldable chair comprising:

a pair of front legs;

a pair of rear legs;

a backrest extending from a top end portion of each of the front legs;

at least one fixed abutment;

a seat pivotally coupled to the front and rear legs;

a collar slidable on the front legs pivotally coupling the front and rear legs, and the collar cooperating with the at least one fixed abutment to stop a spreading-apart of the front and rear legs during an unfolding of the chair to an in-use position; and wherein the at least one fixed abutment is on the backrest.

2. The foldable chair of claim 1, wherein the collar slides in a downward direction upon a folding of the chair and slides in an upward direction upon an unfolding of the chair.

3. The foldable chair of claim 1, wherein a top end portion of the rear legs is pivotally connected to the collar.

4. The foldable chair of claim 1, wherein the at least one fixed abutment extends downwardly from lower end portions of the backrest.

5. The foldable chair of claim 1, wherein the at least one fixed abutment is mounted on the front legs.

6. The foldable chair of claim 1, wherein the at least one fixed abutment is at least two fixed abutments.

7. The foldable chair of claim 1, wherein the seat is pivotally coupled on its lateral sides near its rear end to the rear legs and pivotally coupled to the front legs forward of the pivotal coupling to the rear legs.

8. The foldable chair of claim 1, wherein the collar and the at least one fixed abutment create a gap between the collar and the backrest on the front legs when the chair is in an in-use position.

9. The foldable chair of claim 8, wherein the gap provides means for preventing a person's fingers from getting caught between the collar and the backrest when the chair is being unfolded into an in-use position.

10. A foldable chair comprising:

a pair of front legs;

a pair of rear legs;

a backrest extending from a top end portion of each of the front legs;

at least one fixed abutment;

a seat pivotally coupled to the front and rear legs;

a collar slidable on the front legs pivotally coupling the front and rear legs, and the collar cooperating with the at least one fixed abutment to stop a spreading-apart of the front and rear legs during an unfolding of the chair to an in-use position; and wherein the collar has a pivot assembly including a pivot connector, leg insert and pivot pin to pivotally connect the front and rear legs.

11. The foldable chair of claim 10, wherein the pivot connector includes two spaced-apart reinforcing elements.

12. The foldable chair of claim 10, wherein the pivot connector is connected to the collar by one of adhesive bonding, riveting and screwing.

13. The foldable chair of claim 10, wherein the pivot connector is made monolithically with the collar.

14. The foldable chair of claim 10, wherein the pivot connector reinforces the collar to prevent one or more of breaking, undesirable bending, twisting and other undesirable movement.

15. The foldable chair of claim 10, wherein the leg insert is insertable into a top end portion of the rear legs to pivotally connect the front and rear legs.

16. A foldable chair comprising:
a pair of front lees;
a pair of rear legs;
a backrest extending from a top end portion of each of the front legs;
at least one fixed abutment;
a seat pivotally coupled to the front and rear legs;
a collar slidable on the front legs pivotally coupling the front and rear legs, and the collar cooperating with the at least one fixed abutment to stop a spreading-apart of the front and rear legs during an unfolding of the chair to an in-use position; and
wherein a top end portion of the rear legs is configured to be pivotally connectable to the collar and includes a leg insert and pivot pin to pivotally connect the rear legs to the collar.

17. A foldable chair comprising:
a pair of front legs;
a pair of rear legs;
a backrest extending from a top end portion of each of the front legs;
at least one fixed abutment;
a seat pivotally coupled to the front and rear legs;
a collar slidable on the front legs pivotally coupling the front and rear legs, and the collar cooperating with the at least one fixed abutment to stop a spreading-apart of the front and rear legs during an unfolding of the chair to an in-use position; and
wherein the rear legs have a pivot assembly including a pivot connector, leg insert and pivot pin to pivotally connect the front and rear legs.

18. A foldable chair comprising:
a pair of front legs;
a pair of rear legs;
a backrest extending from a top end portion of each of the front legs;
at least one fixed abutment;
a seat pivotally coupled to the front and rear legs;
a collar slidable on the front legs pivotally coupling the front and rear legs, and the collar cooperating with the at least one fixed abutment to stop a spreading-apart of the front and rear legs during an unfolding of the chair to an in-use position; and
wherein the collar includes an element formed as a lip-shaped extension that cooperates with the at least one fixed abutment to stop a spreading-apart of the front and rear legs during an unfolding of the chair to an in-use position.

19. The foldable chair of claim 18, wherein the lip-shaped extension extends from the collar at an angle such that it acts as a guide and creates a slot to receive the at least one fixed abutment.

20. The foldable chair of claim 19, wherein a combination of the lip-shaped extension, slot and fixed abutment help prevent undesirable rotation of the collar when the chair is in an in-use position.

21. The foldable chair of claim 18, wherein the lip-shaped extension acts as a guard to prevent a person's fingers from getting caught between the collar and the at least one fixed abutment when the chair is moved to an in-use position.

22. A foldable chair comprising:
a pair of front legs;
a pair of rear legs;
a backrest extending from a top end portion of each of the front legs;
a seat pivotally coupled to the front and rear legs;
at least one stopping means;
a connection means slidable on the front legs pivotally coupling the front and rear legs and cooperating with the stopping means to stop a spreading-apart of the front and rear legs during an unfolding of the chair to an in-use position;
wherein the stopping means is at least one fixed abutment; and
wherein the at least one fixed abutment extends downwardly from the backrest.

23. The foldable chair of claim 22, further including a backrest extending from a top end portion of the front legs.

24. The foldable chair of claim 22, further including at least one fixed abutment to stop a spreading apart of the front and rear legs during an unfolding of the chair to an in-use position.

25. The foldable chair of claim 24, wherein the at least one fixed abutment is mounted on the front legs.

26. The foldable chair of claim 24, wherein the at least one fixed abutment is at least two fixed abutments.

27. The foldable chair of claim 22 further including collars on the front legs, and wherein a top end portion of the rear legs is configured to be pivotally connectable to the collars.

28. The foldable chair of claim 27, wherein the collars and the at least one fixed abutment create a gap between the collars and the backrest on the front legs when the chair is in an in-use position.

29. The foldable chair of claim 27, wherein the gap prevents a person's fingers from getting caught between the collars and the backrest when the chair is being unfolded into an in-use position.

30. The foldable chair of claim 27, wherein the collars slide in a downward direction upon a folding of the chair and slide in an upward direction upon an unfolding of the chair.

31. The foldable chair of claim 22, wherein the seat is pivotally coupled on its lateral sides near its rear end to the rear legs and pivotally coupled to the front legs forward of the pivotal coupling to the rear legs.

32. A foldable chair comprising:
a pair of front legs;
a pair of rear legs;
a backrest extending from a top end portion of each of the front legs;
at least one fixed abutment;
a seat pivotally coupled to the front and rear legs;
a collar slidable on the front legs pivotally coupling the front and rear legs, and the collar cooperating with the at least one fixed abutment to stop a spreading-apart of the front and rear legs during an unfolding of the chair to an in-use position;
further including at least one fixed abutment; and
wherein the at least one fixed abutment is on a backrest.

33. The foldable chair of claim 32, wherein the at least one fixed abutment extends downwardly from lower end portions of the backrest.

34. A foldable chair, comprising:
front legs, rear legs and a seat connected in an A-frame arrangement;
collars on the front legs;
the rear legs being pivotally connected to the collars; and
the collars being slidable on the front legs when the chair is moved between folded and in-use positions; and
wherein the collars have a pivot assembly including a pivot connector, leg insert and pivot pin to pivotally connect the front and rear legs.

35. The foldable chair of claim 34, wherein the pivot connector includes two spaced-apart reinforcing elements.

36. The foldable chair of claim 35, wherein the pivot connector is connected to the collar by one of adhesive bonding, riveting and screwing.

37. The foldable chair of claim 34, wherein the pivot connector is made monolithically with the collar.

38. The foldable chair of claim 34, wherein the pivot connector reinforces the collar to prevent one or more of breaking, undesirable bending, twisting and other undesirable movement.

39. The foldable chair of claim 34, wherein the leg insert is insertable into a top end portion of the rear legs to pivotally connect the front and rear legs.

40. A foldable chair, comprising:

front legs, rear legs and a seat connected in an A-frame arrangement;

collars on the front legs;

the rear legs being pivotally connected to the collars;

the collars being slidable on the front legs when the chair is moved between folded and in-use positions;

wherein the collars have a pivot assembly including a pivot connector, leg insert and pivot pin to pivotally connect the front and rear legs;

wherein the pivot connector includes two spaced-apart reinforcing elements; and wherein the pivot connector is connected to the collar by one of adhesive bonding, riveting and screwing.

41. A foldable chair, comprising:

front legs, rear legs and a seat connected in an A-frame arrangement;

collars on the front legs;

the rear legs being pivotally connected to the collars;

the collars being slidable on the front legs when the chair is moved between folded and in-use positions;

wherein the collars have a pivot assembly including a pivot connector, leg insert and pivot pin to pivotally connect the front and rear legs; and wherein the leg insert is insertable into a top end portion of the rear legs to pivotally connect the front and rear legs.

42. A foldable chair, comprising:

front legs, rear legs and a seat connected in an A-frame arrangement;

collars on the front legs;

the rear legs being pivotally connected to the collars;

the collars being slidable on the front legs when the chair is moved between folded and in-use positions;

wherein a top end portion of the rear legs is configured to be pivotally connectable to the collars; and wherein the top end portion of the rear legs includes a leg insert and pivot pin to pivotally connect the rear legs to the collar.

43. A foldable chair, comprising:

front legs, rear legs and a seat connected in an A-frame arrangement;

collars on the front legs;

the rear legs being pivotally connected to the collars;

the collars being slidable on the front legs when the chair is moved between folded and in-use positions; and wherein the rear legs have a pivot assembly including a pivot connector, leg insert and pivot pin to pivotally connect the front and rear legs.

44. A foldable chair, comprising:

front legs, rear legs and a seat connected in an A-frame arrangement;

collars on the front legs;

the rear legs being pivotally connected to the collars;

the collars being slidable on the front legs when the chair is moved between folded and in-use positions;

further including at least one fixed abutment; and wherein the collars include an element formed as a lip-shaped extension that cooperates with the at least one fixed abutment to stop a spreading-apart of the front and rear legs during an unfolding of the chair to an in-use position.

45. The foldable chair of claim 44, wherein the lip-shaped extension acts as a guard to prevent a person's fingers from getting caught between the collars and the at least one fixed abutment when the chair is moved to an in-use position.

46. The foldable chair of claim 44, wherein the lip-shaped extension extends from the collars at an angle such that it acts as a guide and creates a slot to receive the at least one fixed abutment.

47. A foldable chair, comprising:

front legs, rear legs and a seat connected in an A-frame arrangement;

collars on the front legs;

the rear legs being pivotally connected to the collars, the collars being slidable on the front legs when the chair is moved between folded and in-use positions;

at least one fixed abutment;

wherein the collars include an element formed as a lip-shaped extension that cooperates with the at least one fixed abutment to stop a spreading-apart of the front and rear legs during an unfolding of the chair to an in-use position; and wherein the lip-shaped extension extends from the collars at an angle such that it acts as a guide and creates a slot to receive the at least one fixed abutment.

48. The foldable chair of claim 47, wherein a combination of the lip-shaped extension, slot and fixed abutment help prevent undesirable rotation of the collars when the chair is in an in-use position.

49. A foldable chair, comprising:

front legs, rear legs and a seat connected in an A-frame arrangement;

collars on the front legs;

the rear legs being pivotally connected to the collars;

the collars being slidable on the front legs when the chair is moved between folded and in-use positions;

wherein a top end portion of the rear legs is configured to be pivotally connectable to the collars and includes a leg insert and pivot pin to pivotally connect the rear legs to the collar.

* * * * *